US006422523B1

(12) United States Patent
Weshler

(10) Patent No.: US 6,422,523 B1
(45) Date of Patent: Jul. 23, 2002

(54) ADJUSTABLE BRACKET AND UPRIGHT ASSEMBLY

(76) Inventor: Benjamin S. Weshler, 43 Rolling Hill La., Old West, NY (US) 11568

( * ) Notice: Subject to any disclaimer, the term of this patent is extended or adjusted under 35 U.S.C. 154(b) by 0 days.

(21) Appl. No.: 09/536,665

(22) Filed: Mar. 27, 2000

Related U.S. Application Data

(60) Provisional application No. 60/127,165, filed on Mar. 26, 1999.

(51) Int. Cl.[7] ..... A47B 47/00

(52) U.S. Cl. ..... 248/222.52; 248/220.43; 248/220.22; 248/220.31; 248/220.41; 248/222.51; 248/243

(58) Field of Search ..... 248/222.52, 220.43, 248/220.22, 220.31, 220.41, 222.51, 243, 244

(56) References Cited

U.S. PATENT DOCUMENTS 3,606,027 A * 9/1971 Clements ..... 211/176
3,888,441 A * 6/1975 Rebentisch ..... 248/73
4,064,996 A * 12/1977 Shillum ..... 211/191
4,156,515 A * 5/1979 Mochly ..... 248/246
4,342,397 A * 8/1982 Halstrick ..... 211/191
4,886,235 A * 12/1989 Thornborrow ..... 248/225.1
4,971,281 A * 11/1990 Steinbeck ..... 248/225.2
5,351,920 A * 10/1994 Decky et al. ..... 248/73
5,358,205 A * 10/1994 Starkey et al. ..... 248/225.31
D416,471 S * 11/1999 Wurdack ..... D8/363
5,975,318 A * 11/1999 Jay ..... 211/90.01
6,223,916 B1 * 5/2001 Enos ..... 211/187

* cited by examiner

*Primary Examiner*—Leslie A. Braun
*Assistant Examiner*—Steven M. Marsh
(74) *Attorney, Agent, or Firm*—Cowan, Liebowitz & Latman, P.C.

(57) ABSTRACT

A new faceout and upright bracket attachment assembly is constructed of two upright tubes or bars joined by an apertured web. The faceout is constructed so that the bracket is formed with two opposing flanges that are shaped to fit around one upright bar and that project from an end panel at the end of the faceout mounting bar, with one flange being situated slightly higher than the other and being vertically spaced from the lower flange by at least a distance of the width of a vertical upright bar. Each flange also has a notch in its bottom edge to allow the flanges to be positioned securely relative to the web apertures. The faceout bar bracket is locked onto the upright by positioning one of the upright bars between the flanges of the bracket across the face of the faceout end panel and then rotating the faceout bracket 90° about the upright bar such that the flanges mate with web apertures in opposing directions. Another faceout bracket can concurrently be attached to the other side of the upright at the same level by using the other upright tube and the same web apertures.

16 Claims, 2 Drawing Sheets

FIG. 1
PRIOR ART
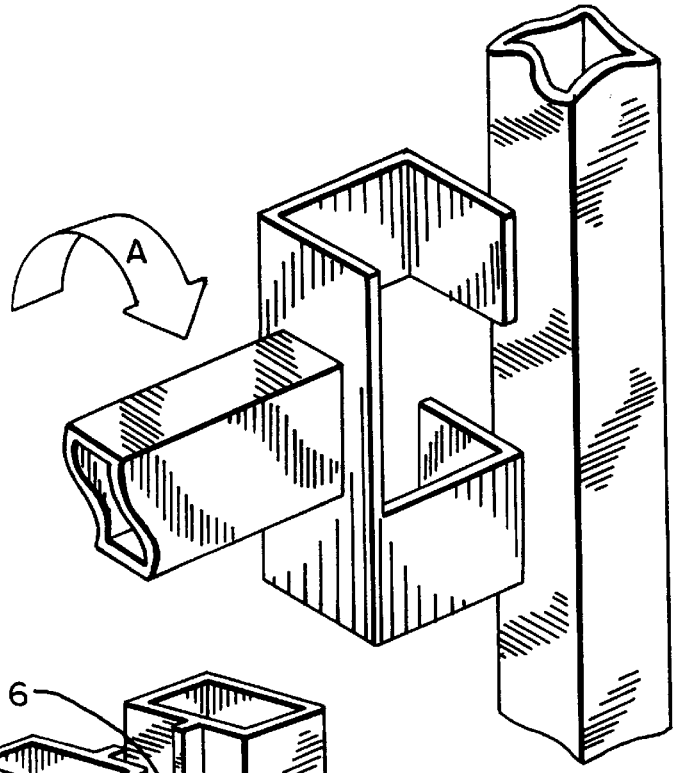
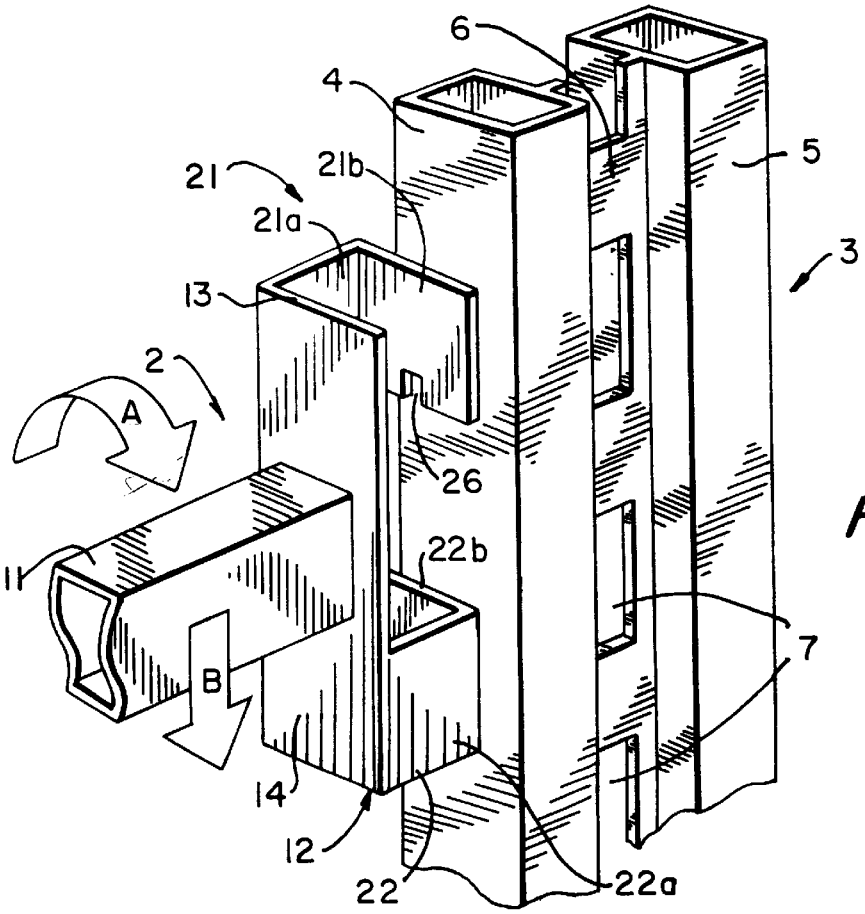
FIG. 2

ADJUSTABLE BRACKET AND UPRIGHT ASSEMBLY

This application claims the benefit of provisional application No. 60/127,165 filed Mar. 26, 1999.

BACKGROUND OF THE INVENTION

This invention relates to the field of bracket assemblies. More particularly, this invention relates to bracket assemblies for adjustably securing a horizontal mounting bar to an upright member for hanging and displaying saleable items.

In the field of clothing retail sales, items are generally displayed on hooks or hangers and are generally hung from racks or some form of horizontal mounting bars. One common type of display stand that is used in retail clothing displays has a vertically-oriented, upright bar mounted into a weighted base. At least one horizontal mounting bar, also known as a "faceout", is secured to the upright so that the mounting bar extends in a substantially perpendicular direction away from the upright. Typically, these faceout bars are disposed on opposite sides of the upright in order to achieve balance of the unit so that clothing hung from a horizontal mounting bar on one side of the upright does not cause the display to topple over. In addition, the faceout bars are generally adjustable with respect to the upright in order to allow the retailer to raise or lower the hanging bars displayed thereon as desired.

Many different types of assemblies have been used for allowing the faceout bars to grip the upright securely. One such assembly is a bracket having a screw that allows the upright to be gripped. In such brackets, the screw could be screwed inward, in a radial direction, so the screw penetrates through or into the hollow interior of the upright and thereby provides the means for stabilizing the faceout relative to the upright. Alternatively, the screw could be screwed inward so that its distal end presses against the upright and grips the upright through friction. In another such bracket, a screw could be screwed tangentially, in a lateral direction through the ends of a bracket that encircles the upright, thereby bringing the ends of the bracket together so that the bracket is tightened and more securely grips the upright. One such bracket is taught in U.S. Pat. No. 5,358,205 (Starkey et al.). In any of these alternatives, the height of the faceout relative to the upright is changed by removing the screw, adjusting the height of the faceout and then replacing the screw.

In retail situations, however, there is a need for a faceout to be quickly and easily adjustable so that a salesperson can change the retail display without using tools. In addition, because these displays are often changed and moved about by people who are not skilled technicians, the adjustability of the faceouts should be foolproof, sturdy and tight-fitting so that the displays will not be broken during adjustment and so that, once adjusted, the position of the faceout will not change. Unfortunately, many of the assemblies that use screws for adjustment are not suitable, because tools are required for adjustment and because tight frictional fits inevitably become loosened over time.

One sturdy type of faceout bracket attachment has a twist-on friction fit using a butterfly-type end, such as that shown in FIG. 1 hereof. This attachment is ideally suited for use with an upright bar having a square or rectangular cross-section. In this bracket, the faceout has a horizontal mounting bar that terminates in a flat base panel surface from which two flanges project. The flange is L-shaped, in that it the flange extends outward from the panel surface, and the end of each flange is bent inward at a 90° angle to allow the flange to fit around and grip the back of the upright having a square- or rectangular-shaped cross-section. One flange is higher than the other, and the flanges are spaced from each other by at least a distance of the width of the upright bar. In order to attach the bracket to the upright, the faceout's flat base panel surface is positioned against the upright in a transverse direction such that the upright rests between the flanges and against the flat surface. Then, the bracket is twisted 90° in the direction of arrow A, such that the flanges frictionally grip the upright.

This connection, because it requires a tight fit between the faceout and the upright, utilizes frictional forces to provide a secure and sturdy connection of the faceout to the upright. However, precisely because of this construction, the faceout is often difficult to adjust relative to the upright. That is, once attached at a specific position on the upright, a faceout is not easily removed and readjusted to a different vertical position on the upright. In addition, a tight frictional connection often tends to move and become less tight over time, causing the faceout to be less securely attached to the upright.

A similar prior art bracket is disclosed in U.S. Pat. No. 5,351,920 (Decky et al.), yet one that aids in attaching a transverse faceout bar. This type of bracket has a flat base panel surface from which two opposing C-shaped flanges project, with one flange being higher than the other and being spaced from the lower flange by at least a distance of the width of the vertical bar to which the flange is to be attached. Since the upright shown in U.S. Pat. No. 5,351,920 has a circular cross-section, the flanges are curved and are shaped to fit around the upright bar. In addition, the interior surfaces of the flanges are threaded in order to allow the bracket to be repositioned relative to an upright threaded rod without having to remove of the bracket. Furthermore, the bracket also has a retention finger that is situated opposite the upper flange for maintaining the threaded rod in place when the bracket is mounted to it. In use, the bracket is positioned such that the upright sits against the inside surface between the flanges, and the bracket is rotated 90°, as shown in FIG. 10, such that the upright rolls over the retention finger and snaps into place gripped by the flanges. This device avoids the pitfalls of purely-frictional attachments by utilizing threads to assist the flanges in gripping the upright.

However, in both of these systems, since the faceout brackets have flanges above and below the level of attachment of the faceout to the upright in order to provide the most secure attachment, it is not possible to set faceouts on opposite sides of the upright at the exact same vertical position. As can be seen in FIG. 1 hereof and in FIG. 3 of U.S. Pat. No. 5,351,920, when a faceout is attached to the upright, the bracket flanges attach to the upright at vertical positions slightly above and below the vertical position of the faceout and prevent any other faceout brackets from being attached there as well. Therefore, difficulties arise when it is desired for one or more faceout brackets to be spaced along the upright, because the upright will be delicately balanced.

SUMMARY OF THE INVENTION

Accordingly, it is one object of this invention to provide an improved assembly for securely attaching a horizontal faceout display bar to an upright bar for retail display purposes.

It is another object of this invention to provide an improved retail display apparatus that would allow a horizontal faceout display bar to be easily and quickly removed from and secured to an upright bar while still providing a secure and stable attachment.

It is a further object of this invention to provide an improved retail display apparatus having an attachment assembly that allows a horizontal faceout display bar to be easily and securely attached to an upright bar on the opposite side of the upright from another faceout.

It is still another object of this invention to provide an improved retail display apparatus having an attachment assembly for easily and securely attaching a horizontal faceout display bar to an upright bar on the same level as another faceout.

These and other objects and advantages of the invention are accomplished in accordance with the principles of the invention by providing a new faceout and upright bracket attachment assembly. In this assembly, the upright is constructed of two upright tubes or bars joined by an apertured web. The faceout is constructed so that the bracket is formed with two opposing flanges that are shaped to fit around one upright bar and that project from an end panel at the end of the faceout mounting bar, with one flange being situated slightly higher than the other and being vertically spaced from the lower flange by at least a distance of the width of a vertical upright bar. Each flange also has a notch in its bottom edge to allow the flanges to be positioned securely relative to the web apertures. The faceout bar bracket is locked onto the upright by positioning one of the upright bars between the flanges of the bracket across the face of the faceout end panel and then rotating the faceout bracket 90° about the upright bar such that the flanges mate with web apertures in opposing directions. Another faceout bracket can concurrently be attached to the other side of the upright at the same level by using the other upright tube and the same web apertures.

BRIEF DESCRIPTION OF THE DRAWINGS

The above and other objects and advantages of the invention will be apparent upon consideration of the following detailed description, taken in conjunction with the accompanying drawings, in which the reference characters refer to like parts throughout and in which:

FIG. 1 shows a perspective view of a prior art bracket in position for attachment to an upright bar with a square cross-sectional shape;

FIG. 2 shows a perspective view of a first embodiment of the bracket assembly of the current invention;

DETAILED DESCRIPTION OF THE INVENTION

Figure 3:
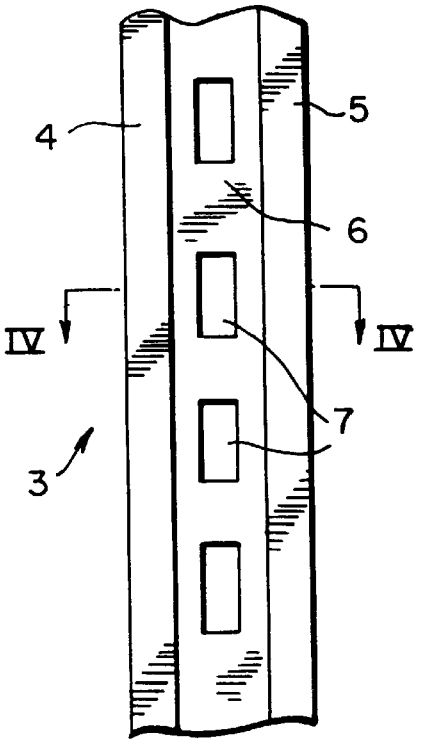
FIG. 3 shows a side view of an upright of the first embodiment of the bracket assembly of the current invention.

Referring to the drawings, in particular to FIGS. 2–5, the bracket assembly 1 of the present invention has a faceout 2 and an upright 3. As discussed above, upright 3 is typically a vertically-oriented support column that is mounted into a weighted base or into a floor or ceiling and onto which hanging displays are attached. Faceout 2 is generally a horizontally-oriented bar that is secured to an upright by some attachment means and from which retail items are generally hung or displayed on hooks or hangers.

In this invention, as shown in FIGS. 2 and 3, upright 3 is formed of two separate bars 4,5 that are joined together by a web 6. Upright 3 is generally elongated in order to allow many faceouts to be attached at various locations along its height. Upright bars 4,5 can have any cross-sectional shape, such as a circle, ellipse, square, rectangle or any other geometrical shape, so long as structural support is provided. In the preferred embodiment shown in FIG. 4, upright bars 4,5 are shown to have the cross-sectional shape of a rectangle.

The dual-bar configuration of upright 3 has several purposes. One purpose, as will be discussed more fully below, allows more than one faceout to be attached to the upright at the same level, thereby conserving space and giving upright 3 more balance. The dual-bar configuration also provides more support for upright 3 in a vertical direction by providing two columns 4,5 to bear the compression load of the weight of the faceouts and their contents, thereby preventing toppling of upright 3. In addition, upright 3 will be much stronger in a flexural direction as a result of having bars 4,5 in parallel, similar to the strength created by a steel I-beam consisting of two sheets of steel joined by a web. Thus, even heavier and wider-spaced loads on faceouts 2 will not cause upright 3 to buckle or to bend, due to the added flexural support provided by two bars 4,5.

Web 6 of upright 3 has several apertures 7 formed completely therethrough. Apertures 7 preferably have a rectangular shape so that flanges at the ends of faceouts 2 can be rotated into apertures 7. Apertures 7 can have other suitable configurations, such as narrow vertical slits that are sufficiently wide to fit one or two flanges at the ends of faceouts 2, as will be discussed below.

Faceout 2 has two portions: an elongated mounting bar 11 and a bracket portion 12. Elongated mounting bar 11 can have any cross-sectional shape, such as a circle, ellipse, square, rectangle or any geometrical shape, so long as it is sufficiently strong structurally to retain retail items typically in hanging fashion on hooks or hangers that depend from mounting bar 11. In the preferred embodiment shown in FIG. 2, elongated mounting bar 11 is shown to have the cross-sectional shape of a vertically-oriented rectangle. Bracket portion 12 is formed preferably as a unitary molded member, and includes a base panel 13 and a pair of oppositely disposed flanges 21,22. Base panel 13 has two opposing planar faces 14,15, of which planar face 14 is attached to mounting bar 11, preferably by some secure attachment means such as by glue or, most preferably, by welding, such that bracket 12 is for all intents and purposes is formed as part of the end of bar 11 and cannot be separated therefrom by substantial shear or bending moment forces. Bracket portion 12 is preferably formed from a hard and inflexible material, such as a hard molded plastic or a metal or metal compound.

The opposite planar face 15 of base panel 13 includes a pair of oppositely disposed flanges 21,22. One flange 21 is disposed from one side edge 16 of face 15 of base panel 13, and the other flange 22 is disposed from the other side edge 17 of face 15 of base panel 13. Preferably, flange 21 is disposed near the top region of side edge 16, and flange 22 is disposed near the bottom region of side edge 17, such that flange 21 is situated higher relative to planar face 15 of base panel 13 than is flange 22.

Figure 4:
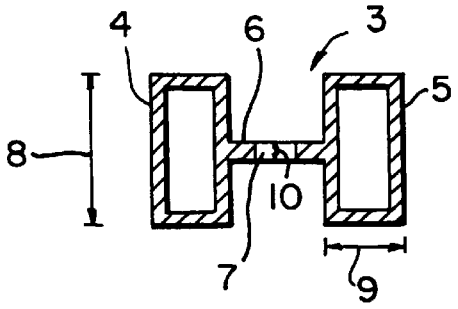
FIG. 4 shows a cross-sectional view of the upright of FIG. 3 taken along line IV—IV of FIG. 3.

Flanges 21,22 can generally have any of a variety of shapes. However, flanges 21,22 are preferably shaped to fit around either of bars 4,5 of upright 3 such that the shape of each of flanges 21,22 matches the cross-sectional shape, such as a circle, ellipse, square, rectangle or any other geometrical shape, of upright bars 4,5. In the preferred embodiment of bracket portion 12 shown in FIG. 5, flanges 21,22 have a rectangular shape to match the rectangular cross-sectional shape of upright bars 4,5 as shown in FIG. 4.

Figure 5:
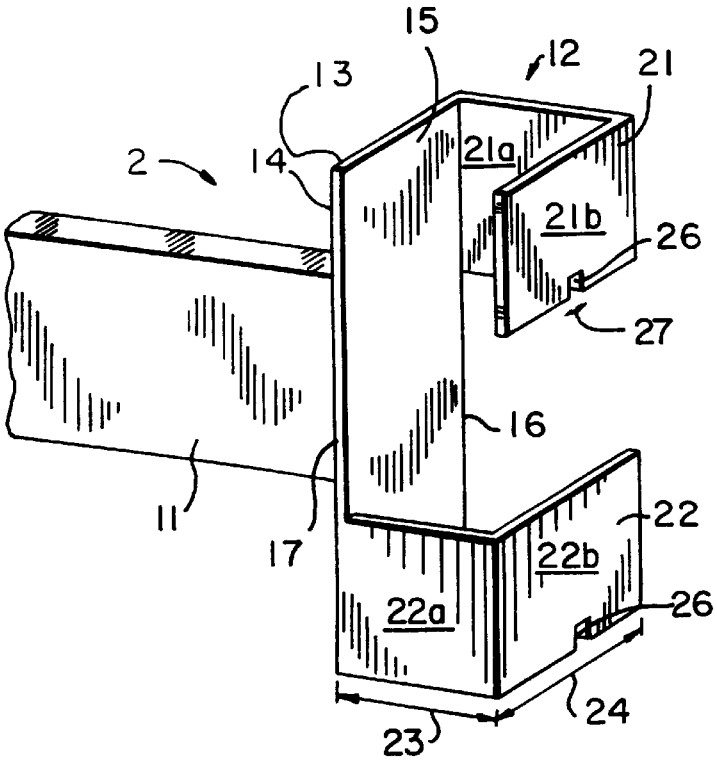
FIG. 5 shows a perspective view of the faceout bracket of the first embodiment of the bracket assembly of the current invention.

As shown in FIGS. 2 and 5, each of flanges 21,22 has a first, proximal (base) portion 21*a*, 22*a* and a second, distal (free) portion 21*b*, 22*b*. Each of flange 21 base portion 21*a* and flange 22 base portion 22*a* is disposed, preferably integrally, from its respective side edge 16,17 of face 15 of panel 13 and project outward from face 15 in a direction generally perpendicular to the surface of face 15, in a direction away from mounting bar 11. Furthermore, each of flange 21 free portion 21*b* and flange 22 free portion 22*b* is disposed at approximately a 90° angle relative to its respective flange base portion 21*a*, 22*a*, such that flange 21 free portion 21*b* and flange 22 free portion 22*b* face inward, in a direction generally toward the center of planar face 15 of base panel 13. As such, each flange 21,22 is L-shaped and faces inward toward the other.

In addition to there being correspondence between the shape of flanges 21,22 of bracket 12 and the shape of upright bars 4,5, there is also correspondence between the dimensions of these parts so that a proper and snug fit is created when mating. For example, in the preferred embodiment, as shown in FIGS. 4 and 5, the width 23 of base portions 21*a*, 22*a* of flanges 21,22 should preferably be slightly greater than the width 9 of bars 4,5. Similarly, the width 24 of free portions 21*b*, 22*b* should preferably be slightly greater than the depth 8 of bars 4,5. In addition, flanges 21,22 should preferably be vertically spaced from each other by a distance of slightly more than the depth 8 of upright bars 4,5. As will be discussed below, these dimensions will allow bracket 12 to be attached to upright 3 without being loose-fitting.

Each of free portions 21*b*, 22*b* of flanges 21,22 also has a notch 26 in its bottom edge. The width 27 of notch 26 should preferably be slightly greater than the thickness 10 of web 6 of upright 3. As will be discussed below, this will allow flanges 21,22 to be positioned securely relative to apertures 7 within web 6.

Faceout 2 is mounted to upright 3 in the following manner. Upright 3 is first positioned such that one of upright bars 4,5, for example upright bar 4, as shown in FIG. 2, is placed against planar face 15 of base panel 13 between flanges 21,22 in a transverse direction to planar face 15 of base panel 13. In this position, the other of upright bars 4,5 (upright bar 5, in the example of FIG. 2) is positioned remotely from face 15 of base panel 13. In order to allow the side of upright bar 4,5 to be placed between flanges 21,22, flanges 21,22 should be vertically spaced from each other by a distance of slightly more than the depth 8 of upright bars 4,5. Once faceout bracket 12 and upright bars 4,5 are so positioned, bracket 12 is rotated 90° in the direction of arrow A (clockwise) about upright bar 4, as shown in FIG. 2. This rotation permits each of flanges 21,22 to pass into and mate with a respective aperture 7 within web 6. Thus, during this rotation, flange 21 rotates upward so that its free end 21*b* hooks into a first aperture 7, such that the inside of base portion 21*a* of flange 21 abuts one side wall of upright bar 4. At the same time, flange 22 rotates downward so that free end 22*b* hooks, in the opposite direction, into the aperture 7 immediately below the first aperture, such that the inside of base portion 22*a* of flange 22 abuts the opposite side wall of upright bar 4.

Of course, the positions of flanges 21,22 relative to planar face 15 of base panel 13 can be reversed, such that flange 21 is disposed near the bottom region of side edge 16 or near the top region of side edge 17 (instead of to the top region of side edge 16, as shown in FIGS. 2 and 5), and flange 22 is disposed near the top region of side edge 17 or near the bottom region of side edge 16 (instead of to the bottom region of side edge 17, as shown in FIGS. 2 and 5), such that flange 21 is situated either higher relative to planar face 15 than is flange 22 or on the opposite sides as previously discussed. In either of these cases, the direction of rotation of bracket 12 portion in order to mount it to upright 3 might have to be reversed, as well known to one of ordinary skill in the art.

Once the rotation of bracket 12 with respect to upright 3 is accomplished, bracket 12 must be centered and secured with respect to upright 3. This is accomplished by adjusting flanges 21,22 within apertures 7 such that each notch 26 in flanges 21,22 is placed immediately over the bottom edge of aperture 7, and then bracket 12 is moved downward in the direction of arrow B with respect to upright 3. Because the width 27 of notch 26 is slightly greater than the thickness 10 of web 6, flanges 21,22 can be positioned securely relative to apertures 7 within web 6 by seating the bottom surfaces of apertures 7 within notches 26. The hanging of various display items on mounting bar 11 of faceout 2 creates downward force on mounting bar 11 and bracket 12 of faceout 2, as well as on flanges 21,22. Accordingly, notches 26 are held in position about the bottom edge of apertures 7, thereby maintaining the support of bracket 12 of faceout 2 on upright 3.

During the process of mounting of faceout 2 to upright 3 within web 6, the inside surface of free end 21*b* of flange 21 abuts the inside surface of the upper aperture 7 closest to upright bar 4, while the inside surface of free end 22b of flange 22 abuts the inside surface of the lower aperture 7 closest to upright bar 4. However, the width of each of apertures 7 within web 6 are such that the thickness of more than one flange 21,22 can fit. Accordingly, another bracket 12 of another faceout 2 can concurrently be attached to the other bar 5 of upright 3 at the exact same vertical level using the same apertures 7 in web 6. Thus, upright 3 can have two faceouts 2 attached at the exact same vertical level.

It will be appreciated that the cross-sectional shapes of the upright bars and of the flanges can have cross-sectional shapes other than the square or rectangular cross-sectional shape illustrated in FIGS. 2–5. For example, the upright can be composed of two cylindrically- or elliptically-shaped bars joined by an apertured web, and the flanges can be appropriately C-shaped to match the shapes of the bars. As with the preferred embodiment, rotation of the curved flanges relative to one of the upright bars permits the flanges to be wrapped around that upright bar such that the free ends of the flanges pass through web apertures in opposite directions. In addition, another bracket with similarly shaped flanges can be attached to the upright at the same time and at the same vertical level by inserting the flanges of that bracket through the same web apertures from the other side, i.e., by attaching it to the other upright bar in the same manner as discussed above.

Thus, an adjustable bracket and upright assembly and a method of attaching the same has been provided. One skilled in the art will appreciate that the present invention can be practiced by other than the described embodiments, which are presented for purposes of illustration and not limitation.

I claim:

1. An adjustable bracket assembly, comprising:

a vertical support member having at least one elongated member;

a web extending outward from and along the height of said at least one elongated member, said web having at least one aperture formed therethrough;

a horizontal support member having a proximal end, said proximal end having two opposing flanges for mounting said horizontal support member onto said vertical support member, said two opposing flanges being spaced both laterally and vertically from each other;

whereby said horizontal support member is adjustably mounted relative to said vertical support member by placement of said proximal end of said horizontal support member relative to said vertical support member such that one said flange is situated on either side of said elongated member whereby said elongated member extends laterally between said flanges on said proximal end, and by rotation of said horizontal support member relative to said vertical support member, such that said flanges on said proximal end of said horizontal support member are rotated relative to said elongated member and such that each of said flanges on said proximal end enters a respective aperture in said web.

2. The adjustable bracket assembly of claim 1 wherein said vertical support member comprises two elongated members and a web extending between and joining said elongated members along at least a part of the height of one of said elongated members, said web having at least one aperture formed therethrough.

3. The adjustable bracket assembly of claim 2 wherein said web comprises at least two apertures formed therethrough, such that, when said horizontal support member is rotated relative to said vertical support member and said flanges on said proximal end of said horizontal support member are rotated relative to a first elongated member, each of said flanges on said proximal end enter a respective one of said two apertures formed through said web.

4. The adjustable bracket assembly of claim 2 wherein both said web and said at least two apertures have sufficient width, such that two horizontal support members may be attached to said vertical support member at one time and through the same two apertures, whereby a first of said horizontal support members is attached to a first elongated member and the flanges of said first horizontal support member cooperate with said two apertures from one side at the same time as a second of said horizontal support members is attached to a second elongated member and the flanges of said second horizontal support member cooperate with said two apertures from the opposite side.

5. The adjustable bracket assembly of claim 1 wherein said horizontal support member comprises a horizontal support bar having a proximal end and further comprises a flat base member attached on a first side to said proximal end, said two opposing flanges being secured to a second side of said flat base member for adjustably mounting said horizontal support member onto said vertical support member, said two opposing flanges being spaced laterally on opposite side edges of said base member and being spaced vertically from each other.

6. The adjustable bracket assembly of claim 5 wherein said opposing flanges are L-shaped, with the base end of each flange being attached at an opposing side edge of said second side of said base member and the free end of each flange extending toward the center of said base member.

7. The adjustable bracket assembly of claim 6 wherein said at least one elongated member of said vertical support member has the cross sectional shape of a rectangle or a square.

8. The adjustable bracket assembly of claim 5 wherein said opposing flanges are spaced vertically from each other by at least the width of said at least one elongated member.

9. The adjustable bracket assembly of claim 5 wherein said opposing flanges are L-shaped, and the base end of each flange is attached at an opposing side edge of said second side of said base member and is spaced laterally the base end of the other flange by at least the width of said at least one elongated member.

10. The adjustable bracket assembly of claim 1 wherein said web comprises at least two apertures formed therethrough, each aperture having top, bottom and two side edges, and wherein each said opposing flange has a free end that extends towards said other flange and that has a notch cut into the bottom edge of said free end, such that, when said each of said flanges on said proximal end enters a respective one of said apertures formed through said web, said notch can be situated about said bottom edge of said aperture, so as to securely set said flange relative to said aperture.

11. The adjustable bracket assembly of claim 10 wherein the width of said notch is slightly larger than the width of said bottom edge of said aperture.

12. In combination with a horizontal support member having a proximal end and a vertical support member having at least two elongated members and a web extending between and joining said two elongated members along at least a part of the height of said elongated members, said web having at least two apertures formed therethrough, an adjustable bracket assembly comprising:

two opposing flanges disposed on said proximal end of said horizontal support member, each flange having an attachment portion and a free portion, the attachment portions of said two opposing flanges being spaced laterally from each other by at least the width of one of said two elongated members, and the free portions of said two opposing flanges being spaced vertically from each other by at least the width of one of said elongated members;

whereby said horizontal support member is adjustably mounted relative to said vertical support member by placement of said proximal end of said horizontal support member relative to said vertical support member such that one said flange is situated on either side of said one of said two elongated members whereby said one of said two elongated members extends laterally between said flanges on said proximal end, and by rotation of said horizontal support member relative to said vertical support member, such that said flanges on said proximal end of said horizontal support member are rotated relative to said one of said two elongated members and such that each of said flanges on said proximal end enters a respective one of said two apertures formed through said web.

13. The adjustable bracket assembly of claim 12 wherein said at least two apertures have sufficient width, such that two horizontal support members may be attached to said vertical support member at one time and through the same two apertures, whereby a first horizontal support member is attached to a first elongated member and the flanges of said first horizontal support member cooperate with said two apertures from one side at the same time as a second of said horizontal support members is attached to a second elongated member and the flanges of said second horizontal support member cooperate with said two apertures from the opposite side.

14. The adjustable bracket assembly of claim 12 wherein said horizontal support member comprises a horizontal support bar having a proximal end and further comprises a flat base member attached on a first side to said proximal end, said two opposing flanges being secured to a second side of said flat base member for adjustably mounting said horizontal support member onto said vertical support member.

15. The adjustable bracket assembly of claim 12 wherein each said aperture has a top, a bottom and two side edges, and wherein the free portion of each said opposing flange has a notch cut into the bottom edge of said free portion, such that, when said each of said flanges enters a respective one of said apertures formed through said web, said notch can be situated about said bottom edge of said aperture, so as to securely set said flange relative to said aperture.

16. The adjustable bracket assembly of claim 15 wherein the width of said notch is slightly larger than the width of said bottom edge of said aperture.

* * * * *